US007273084B2

(12) United States Patent
Chen

(10) Patent No.: US 7,273,084 B2
(45) Date of Patent: Sep. 25, 2007

(54) SHOWER SCREEN

(76) Inventor: Chang Than Chen, 12F, No. 426, Ming Chuan 2nd Road, Chien Chen Chu, Kaohsiung 801 (TW)

( * ) Notice: Subject to any disclaimer, the term of this patent is extended or adjusted under 35 U.S.C. 154(b) by 400 days.

(21) Appl. No.: 11/005,902

(22) Filed: Dec. 7, 2004

(65) Prior Publication Data

US 2006/0230524 A1 Oct. 19, 2006

(51) Int. Cl.
*E05D 15/26* (2006.01)

(52) U.S. Cl. ..... 160/187; 160/196.1

(58) Field of Classification Search ..... 160/199, 160/196.1, 206, 186, 187, DIG. 6; 4/557, 4/558, 607, 608, 610
See application file for complete search history.

(56) References Cited

U.S. PATENT DOCUMENTS 2,897,515 A * 8/1959 Collins ..... 4/608
3,037,555 A * 6/1962 Kochanowski ..... 160/186
3,418,666 A * 12/1968 Rockey ..... 4/608
3,500,481 A * 3/1970 McKwane ..... 4/558
3,994,330 A * 11/1976 Laby ..... 160/199
4,014,377 A * 3/1977 Kochanowski ..... 160/186
4,014,378 A * 3/1977 Kochanowski ..... 160/186
4,256,164 A * 3/1981 Agcaoili ..... 160/186
4,258,443 A * 3/1981 Baus ..... 4/557
5,822,810 A * 10/1998 Chen ..... 4/610
6,182,738 B1 * 2/2001 Chen ..... 160/199
6,325,135 B1 * 12/2001 Lee ..... 160/199

* cited by examiner

*Primary Examiner*—David Purol
(74) *Attorney, Agent, or Firm*—Charles E. Baxley

(57) ABSTRACT

A shower screen includes an upper guide rod secured on top of two posts, a screen member having a number of panels foldably coupled together and having an upper portion slidably attached to the guide rod, and two beams secured to sides of the screen member. A lower guide bar is secured to lower portions of the posts, and includes a downwardly facing passage. The beams and the screen member each includes a hook member or hook device having a projection slidably engaged into the passage of the guide bar, to anchor the lower portions of the beams and the screen member to the guide bar, and to prevent the beams and the screen member from fluctuating or vibrating relative to the guide bar.

3 Claims, 3 Drawing Sheets

SHOWER SCREEN

BACKGROUND OF THE INVENTION

1. Field of the Invention

The present invention relates to a shower screen, and more particularly to a shower screen having a solidly and smoothly anchoring structure for coupling and retaining foldable panels of a screen member.

2. Description of the Prior Art

The applicant has developed various kinds of typical shower screens and comprise a guide rod and a guide bar secured between top and lower portions of two spaced side posts, and a screen member having a number of foldable panels foldably and slidably attached between the guide rod and the guide bar.

For example, U.S. Pat. No. 5,822,810 to Chen discloses one of the typical shower screens which also comprise a screen member having a number of foldable panels foldably and slidably attached between a guide rod and a guide bar that are secured between top and lower portions of two spaced side posts, and two side beams attached to side portions of the panels.

The side beams each includes a notch formed in lower portion thereof, for engaging with the lower guide bar, and for guiding the foldable panels of the screen member to slide along the lower guide bar. However, the side beams may not be stably anchored or coupled to the lower guide bar, and may move or fluctuate relative to the lower guide bar.

U.S. Pat. No. 6,182,738 to Chen discloses another typical shower screen comprising a screen member having two retaining members attached to two side beams respectively, for engaging with the lower guide bar, and for guiding the foldable panels of the screen member to slide along the lower guide bar. However, the retaining members of the side beams are also simply contacted with the lower guide bar, and the foldable panels of the screen member may also move or fluctuate relative to the lower guide bar, such that the screen member also may not be stably anchored or coupled to the lower guide bar.

The present invention has arisen to mitigate and/or obviate the afore-described disadvantages of the conventional shower screens.

SUMMARY OF THE INVENTION

The primary objective of the present invention is to provide a shower screen including a solidly and smoothly anchoring structure for coupling and retaining foldable panels of a screen member.

In accordance with one aspect of the invention, there is provided a shower screen comprising a pair of vertical posts each including a longitudinal channel formed therein, and each including a lower portion, an upper guide rod secured on top of the posts, a screen member including a number of panels foldably coupled together with foldable hinges, and each having an upper portion slidably attached to the guide rod, for allowing the panels to be folded to a folding position and to be unfolded to an open and working position, the screen member including two side portions and including a lower portion, two beams secured to the side portions of the screen member respectively, and each including a protrusion extended outwardly therefrom, for engaging into the channels of the posts respectively, and for retaining the panels of the screen member in the open and working position, to prevent spilling while showering, the beams each including a lower portion, a lower guide bar secured to the lower portions of the posts, and including an outer wall extended upwardly therefrom, an upper wall extended laterally from the outer wall, and an inner wall extended downwardly from the upper wall, to form and define a downwardly facing passage therein. The beams each includes a hook member secured to the lower portion thereof and having an upwardly extending projection provided thereon, to slidably engage into the passage of the guide bar, and to anchor the lower portions of the beams to the guide bar, and to prevent the lower portions of the beams from fluctuating relative to the guide bar, and at least one hook device is attached to the lower portion of the screen member, and includes an upwardly extending projection provided thereon, to slidably engage into the passage of the guide bar, and to anchor the lower portion of the screen member to the guide bar, and to prevent the lower portion of the screen member from fluctuating relative to the guide bar. It is to be noted that the hook members and the hook devices may stably couple the lower portions of the screen member and the beams to the lower guide bar, such that the lower portions of the screen member and the beams will not be moved or fluctuated or vibrated relative to the lower guide bar.

The hook devices each includes a coupling device pivotally secured thereto with a pivot pin, to allow the hook device to be pivoted relative to the coupling device. The coupling devices of the hook devices each includes an upwardly facing slot formed therein and defined between two plates, to slidably receive the panels of the screen member respectively.

The coupling devices each includes a catch extended from either of the plates thereof, and extended into the slot thereof, for engaging through the lower portion of the screen member, and for solidly securing the coupling devices and the hook devices to the lower portions of the screen member.

The posts each includes a bracket secured on top thereof and having a key provided therein, the guide rod includes two ends engaged in the brackets respectively, and includes a groove formed therein and having two ends engaged with the keys, to anchor the guide rod to the posts with the brackets.

The panels of the screen member each includes a roller provided thereon, and slidably engaged in the groove of the guide rod, to allow the panels to be folded to the folding position, and to be unfolded to the open and working position.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
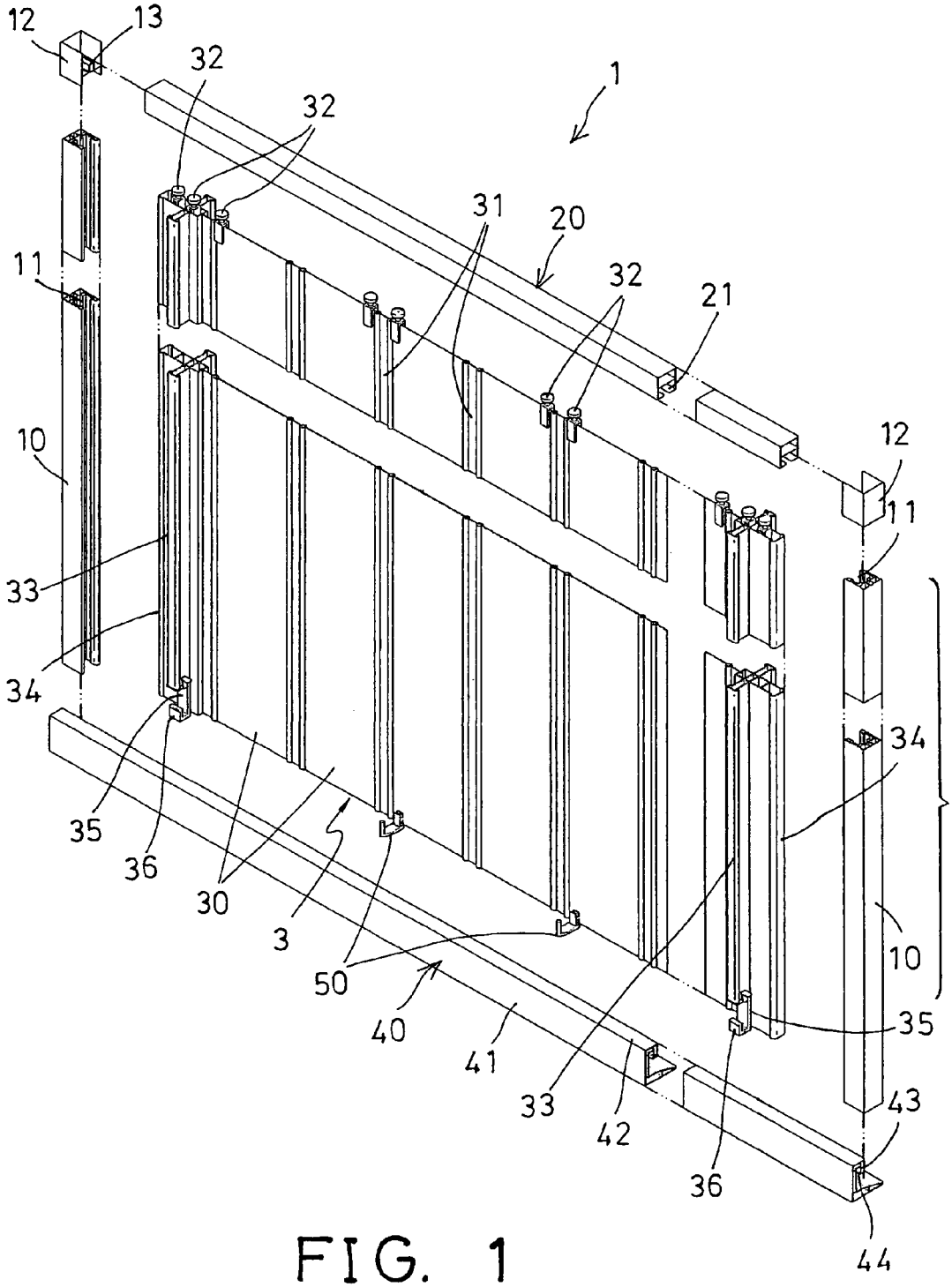
FIG. 1 is a partial exploded view of a shower screen in accordance with the present invention.
Figure 2:
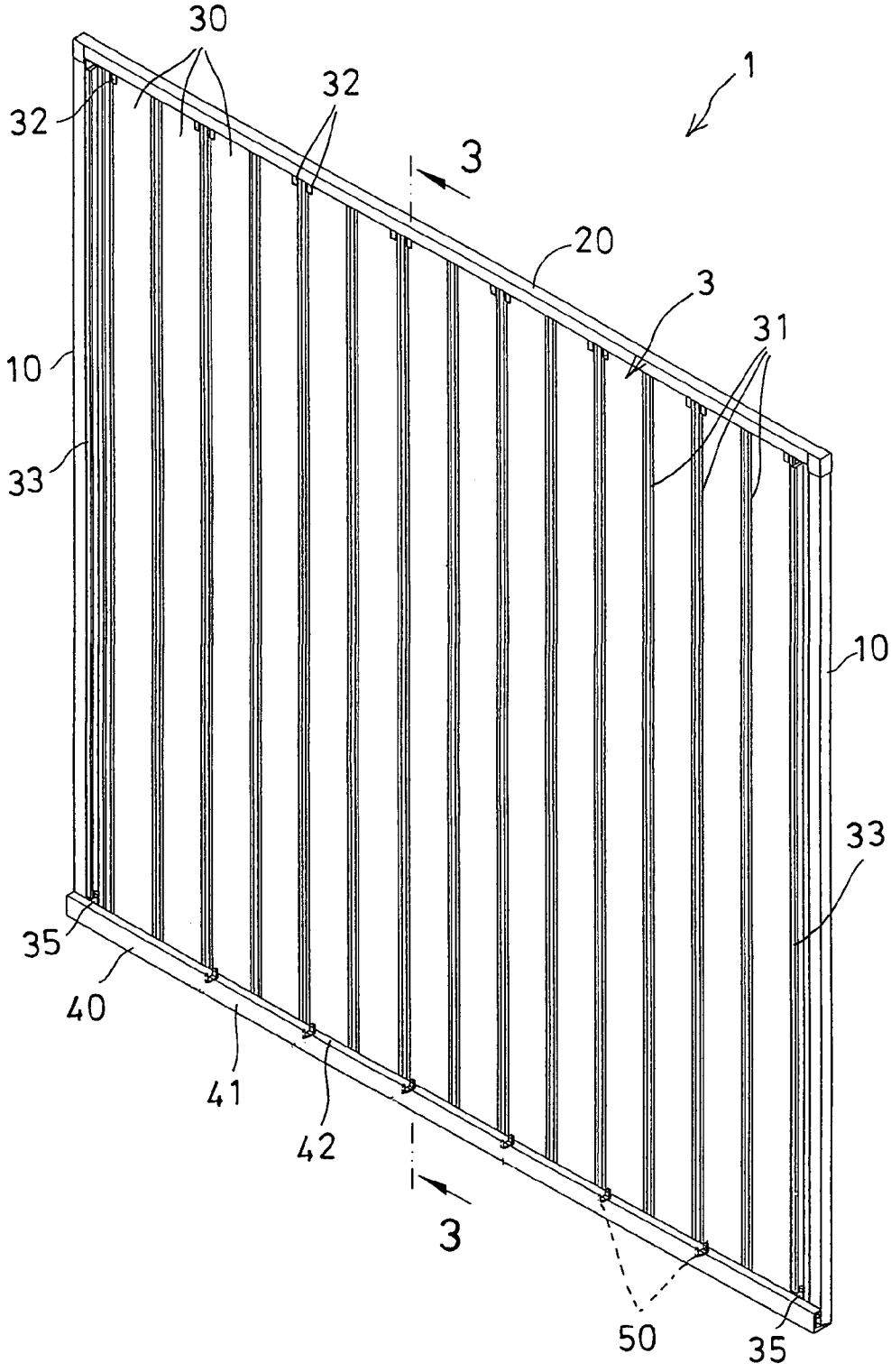
FIG. 2 is a perspective view of the shower screen.
Figure 3:
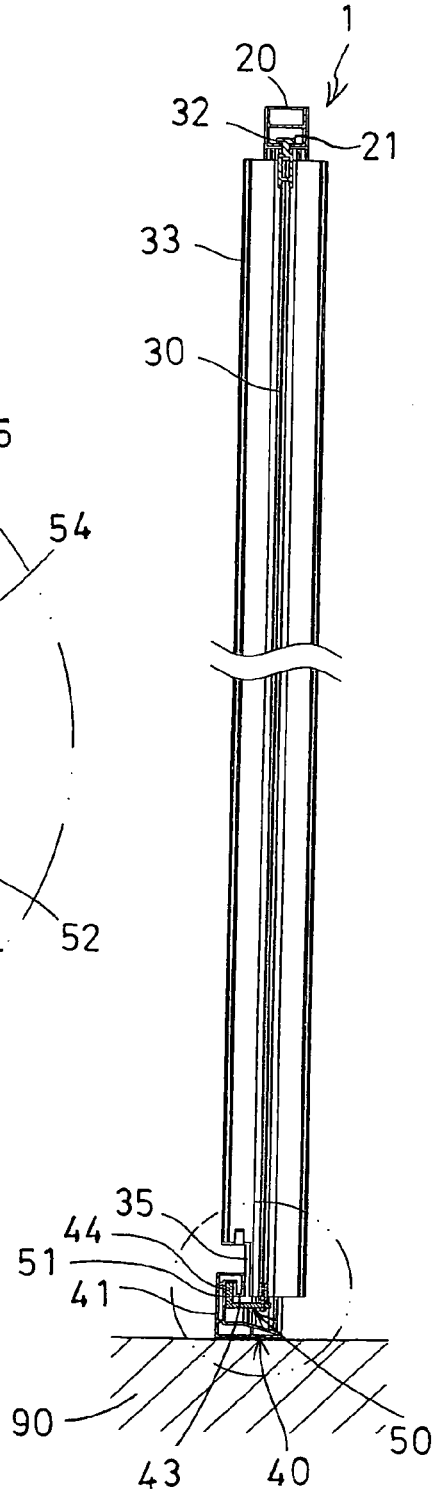
FIG. 3 is a cross sectional view taken along lines 3-3 of FIG. 2.

Referring to the drawings, and initially to FIGS. 1-3, a shower screen 1 in accordance with the present invention comprises a pair of vertical posts 10 each including a longitudinal channel 11 formed therein and facing toward each other. Two brackets 12 are secured on top of the posts 10 respectively, and each includes a key 13 provided therein (FIG. 1).

An upper guide rod 20 includes two end portions engaged in or attached to the brackets 12, and includes a groove 21 formed in the lower portion thereof and having two ends engaged with the respective keys 13, for anchoring and securing or coupling the guide rod 20 to the posts 10 with the brackets 12, and for preventing the guide rod 20 from rotating relative to the brackets 12 and the posts 10.

A screen member 3 includes a number of panels 30 foldably secured or coupled together with foldable lines or hinges 31, for allowing the panels 30 to be folded relative to each other to form a zigzag shape. Each of the panels 30 includes a slide or roller 32 provided on or attached to top thereof, and slidably engaged in the groove 21 of the guide rod 20, for allowing the panels 30 to be folded to the zigzag folding position, or unfolded to a widely open or working position.

Two beams 33 are secured to two side portions of the panels 30, and each includes a rib or protrusion 34 extended outwardly therefrom, for engaging into the channels 11 of the respective posts 10, and for retaining the panels 30 of the screen member 3 in the widely open or working position, in order to prevent spilling while showering.

A lower guide bar 40 is attached to top of a bathtub 90 (FIGS. 3, 4) or the like, and secured to lower portions of the posts 10 for forming a bottom block and guide member, and for partially blocking or shielding the lower portions of the panels 30 of the screen member 3, to prevent water spilling while showering. The above-described structure is typical, and will not be described in further details. The related folding structure has been disclosed in U.S. Pat. No. 5,822,810 to Chen and U.S. Pat. No. 6,182,738 to Chen, which may thus be taken as references for the present invention.

Figure 4:
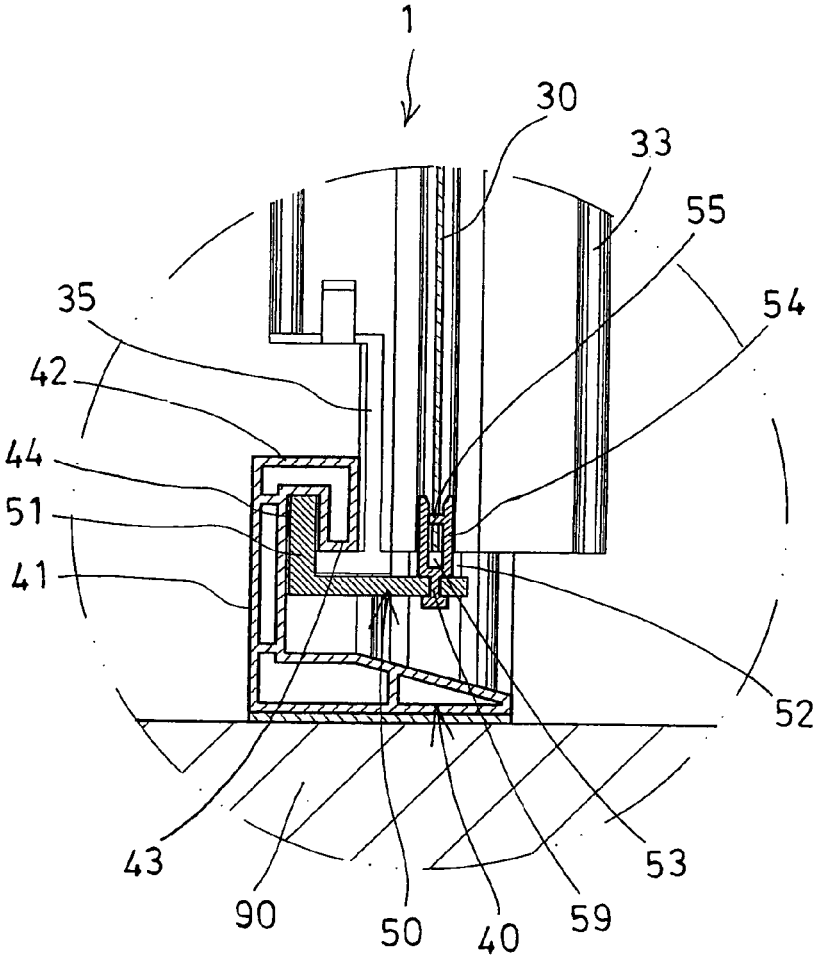
FIG. 4 is an enlarged partial cross sectional view of the shower screen.

As best shown in FIGS. 3, 4, the lower guide bar 40 includes an outer wall 41 extended upwardly therefrom, an upper wall 42 extended laterally and inwardly from top of the outer wall 41, and an inner wall 43 extended or dependent downwardly from inner portion of the upper wall 42, to form a substantially inverted L-shaped structure, and to define a downwardly extending or facing passage 44 therein.

The beams 33 each includes a hook member 35 secured to lower portion thereof and having an upwardly extending projection 36 formed or provided on an outer portion thereof, for slidably engaging into the passage 44 of the guide bar 40, and for anchoring the lower portions of the beams 33 to the guide bar 40, and thus to prevent the lower portions of the beams 33 from moving or fluctuating or vibrating relative to or away from the lower guide bar 40.

It is preferable that one or more of the panels 30 of the screen member 3 each further includes a hook device 50 secured to lower portion thereof and also having an upwardly extending projection 51 formed or provided on an outer portion thereof, for slidably engaging into the passage 44 of the guide bar 40, and for anchoring the lower portions of the panels 30 to the guide bar 40, and to prevent the lower portions of the panels 30 from moving or fluctuating away from the lower guide bar 40.

As best shown in FIG. 4, each of the hook device 50 includes a coupling device 52 rotatably or pivotally attached or secured to an inner portion thereof with a pivot pin 59, to allow the hook device 50 to be rotated or pivoted relative to the coupling device 52. Each of the hook devices 50 includes an upwardly extending or facing slot 53 formed therein and defined between two plates 54, for slidably receiving the panels 30 of the screen member 3 respectively.

The coupling device 52 includes a catch 55 extended from one of the plates 54 thereof, and extended toward the other plate 54, and extended into the slot 53 thereof, for engaging through the lower portions of the panels 30, and for solidly securing the coupling devices 52 and thus the hook devices 50 to the lower portions of the panels 30.

The bottom or lower portions of the panels 30 and beams 33 of the screen member 3 may thus be stably and slidably coupled to the lower guide bar 40 with the hook members 35 and the hook devices 50 respectively, to prevent the bottom or lower portions of the panels 30 and beams 33 of the screen member 3 from moving or fluctuating away from the lower guide bar 40, such that the screen member 3 may be stably and smoothly anchored or coupled to the lower guide bar 40.

It is preferable that the hook devices 50 are aligned with the slides or rollers 32 of the panels 30 of the screen member 3 respectively, to allow the panels 30 to be smoothly rotated or folded and unfolded relative to the upper guide rod 20 and the lower guide bar 40.

Accordingly, the shower screen in accordance with the present invention includes a solidly and smoothly anchoring structure for coupling and retaining foldable panels of a screen member.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A shower screen comprising:

a pair of vertical posts each including a longitudinal channel formed therein, and each including a lower portion, an upper guide rod secured on top of said posts, a screen member including a plurality of panels foldably coupled together with foldable hinges, and each having an upper portion slidably attached to said guide rod, for allowing said panels to be folded to a folding position and to be unfolded to an open and working position, said screen member including two side portions and including a lower portion, two beams secured to said side portions of said screen member respectively, and each including a protrusion extended outwardly therefrom, for engaging into said channels of said posts respectively, and for retaining said panels of said screen member in said open and working position, to prevent spilling while showering, said beams each including a lower portion, a lower guide bar secured to said lower portions of said posts, and including an outer wall extended upwardly therefrom, an upper wall extended laterally from said outer wall, and an inner wall extended downwardly from said upper wall, to form and define a downwardly facing passage therein, said beams each including a hook member secured to said lower portion thereof and having an upwardly extending projection provided thereon, to slidably engage into said passage of said guide bar, and to anchor said lower portions of said beams to said guide bar, and to prevent said lower portions of said beams from fluctuating relative to said guide bar, and at least one hook device attached to said lower portion of said screen member, and including an upwardly extending projection provided thereon, to slidably engage into said passage of said guide bar, and to anchor said lower portion of said screen member to said guide bar, and to prevent said lower portion of said screen member from fluctuating relative to said guide bar, said at least one hook device including a coupling device pivotally secured thereto with a pivot pin to allow said at least one hook device to be pivoted relative to said coupling device, said coupling device of said at least one hook device including an upwardly facing slot formed therein and defined between two plates to slidably receive said panels of said screen member respectively, and said coupling device including a catch extended from either of said plates thereof, and extended into said slot thereof for engaging through said lower portion of said screen member and for solidly securing said coupling device and said at least one hook device to said lower portions of said screen member.

2. The shower screen as claimed in claim 1, wherein said posts each includes a bracket secured on top thereof and having a key provided therein, said guide rod includes two ends engaged in said brackets respectively, and includes a groove formed therein and having two ends engaged with said keys, to anchor said guide rod to said posts with said brackets.

3. The shower screen as claimed in claim 2, wherein said panels of said screen member each includes a roller provided thereon, and slidably engaged in said groove of said guide rod, to allow said panels to be folded to said folding position, and to be unfolded to said open and working position.

* * * * *